US008788276B2

(12) United States Patent
Neuendorf et al.

(10) Patent No.: US 8,788,276 B2
(45) Date of Patent: Jul. 22, 2014

(54) APPARATUS AND METHOD FOR CALCULATING BANDWIDTH EXTENSION DATA USING A SPECTRAL TILT CONTROLLED FRAMING

(75) Inventors: Max Neuendorf, Nuremberg (DE); Ulrich Kraemer, Stuttgart (DE); Frederik Nagel, Nuremberg (DE); Sascha Disch, Fuerth (DE); Stefan Wabnik, Oldenburg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 809 days.

(21) Appl. No.: 12/740,610

(22) PCT Filed: Jun. 23, 2009

(86) PCT No.: PCT/EP2009/004520

§ 371 (c)(1),
(2), (4) Date: Jan. 6, 2011

(87) PCT Pub. No.: WO2010/003543

PCT Pub. Date: Jan. 14, 2010

(65) Prior Publication Data

US 2011/0099018 A1 Apr. 28, 2011

Related U.S. Application Data

(60) Provisional application No. 61/079,871, filed on Jul. 11, 2008.

(51) Int. Cl.
*G10L 19/00* (2013.01)

(52) U.S. Cl.
USPC ..... 704/500; 704/501; 704/502; 704/503; 704/504

(58) Field of Classification Search
USPC ..... 704/500, 501, 502, 503, 504
See application file for complete search history.

(56) References Cited

U.S. PATENT DOCUMENTS 6,453,282 B1 9/2002 Hilpert et al.
7,379,866 B2 * 5/2008 Gao ..... 704/220

(Continued)

FOREIGN PATENT DOCUMENTS

EP 1677088 7/2006
JP 2006023658 1/2006

(Continued)

OTHER PUBLICATIONS

Geiger, et al., "Enhanced MPEG-4 Low Delay AAC—Low Bitrate High Quality Communication", Audio Engineering Society, Convention Paper 6998, Presented at the 122nd Convention, Vienna, Austria, May 5-8, 2007, 13 pages.

(Continued)

*Primary Examiner* — Qi Han
(74) *Attorney, Agent, or Firm* — Michael A. Glenn; Perkins Coie LLP

(57) ABSTRACT

An apparatus for calculating bandwidth extension data of an audio signal in a bandwidth extension system, in which a first spectral band is encoded with a first number of bits and a second spectral band different from the first spectral band is encoded with a second number of bits, the second number of bits being smaller than the first number of bits, has a controllable bandwidth extension parameter calculator for calculating bandwidth extension parameters for the second frequency band in a frame-wise manner for a sequence of frames of the audio signal. Each frame has a controllable start time instant. The apparatus additionally includes a spectral tilt detector for detecting a spectral tilt in a time portion of the audio signal and for signaling the start time instant for the individual frames of the audio signal depending on spectral tilt.

19 Claims, 7 Drawing Sheets

(56) References Cited

U.S. PATENT DOCUMENTS

| | | | | |
|---|---|---|---|---|
| 2001/0023396 | A1* | 9/2001 | Gersho et al. | 704/220 |
| 2002/0116182 | A1* | 8/2002 | Gao et al. | 704/205 |

FOREIGN PATENT DOCUMENTS

| | | | |
|---|---|---|---|
| JP | 2007333785 | | 12/2007 |
| RU | 2224302 | C2 | 12/1997 |
| TW | I303410 | | 7/1992 |
| TW | I308740 | | 1/1996 |
| TW | I271703 | | 1/2007 |
| WO | WO-00/45378 | | 8/2000 |
| WO | WO-2006/107837 | | 10/2006 |

OTHER PUBLICATIONS

Goncharoff, et al., "Efficient Calculation of Spectral Tilt from Various LPC Parameters", May 1, 1996, Naval Command Control and Ocean Surveillance Center (NCCOSC), RDT and E Division, XP009092156, pp. 1-4.

* cited by examiner

| output signal from | | parameter calculator reaction |
|---|---|---|
| tilt. det | trans. det. | |
| 0 | 0 | proceed as before |
| 0 | 1 | set first border with low time resolution |
| 1 | 0 | set first border with high time resolution |
| 1 | 1 | set first border with high time resolution |

FIG 1C $$c_k = \frac{1}{k}\sum_{n=1}^{N}(p_n)^k$$

cepstral coefficients corresponding to the $N^{th}$ order all-pole log power spectrum $$m = \frac{-48}{\pi^3}\sum_{k=1,3,5,\cdots}^{\infty}\left\{\frac{1}{k^3}\sum_{n=1}^{N}(p_n)^k\right\}$$

spectral tilt in terms of the cepstral coefficients $$S(\omega) = \ln\left|H\left(e^{j\omega}\right)\right|^2 = \ln G^2 - \ln\left|1-\sum_{k=1}^{N}\alpha_k e^{-j\omega k}\right|^2$$

log power spectrum of the $N^{th}$ order LPC filter $$c_k = \begin{cases} \alpha_k + \frac{1}{k}\sum_{n=1}^{k-1} n c_n \alpha_{k-n}, & 1 \le k \le N; \\ \frac{1}{k}\sum_{n=k-N}^{k-1} n c_n \alpha_{k-n}, & k > N. \end{cases}$$

cepstral coefficients $c_k$ in dependece on LPC coefficients $\alpha_k$
$\alpha_1$ : first LPC coefficient - has positive or negative sign

FIG 2C
(PRIOR ART)

APPARATUS AND METHOD FOR CALCULATING BANDWIDTH EXTENSION DATA USING A SPECTRAL TILT CONTROLLED FRAMING

CROSS-REFERENCE TO RELATED APPLICATION

This application is a U.S. National Phase entry of PCT/EP2009/004520 filed Jun. 23, 2009, and claims priority to U.S. patent application Ser. No. 61/079,871 filed Jul. 11, 2008, each of which is incorporated herein by references hereto.

BACKGROUND OF THE INVENTION

The present invention is related to audio coding/decoding and, particularly, to audio coding/decoding in the context of bandwidth extension (BWE). A well known implementation of BWE is spectral bandwidth replication (SBR), which has been standardized within MPEG (Moving Picture Expert Group).

WO 00/45378 discloses an efficient spectral envelope coding using variable time/frequency resolution and time/frequency switching. An analogue input signal is fed to an A/D converter, forming a digital signal. The digital audio signal is fed to a perceptual audio encoder, where source coding is performed. In addition, the digital signal is fed to a transient detector and to an analysis filter bank, which splits the signal into its spectral representation (subband signals). The transient detector operates on the subband signals from the analysis bank or operates on the digital time domain samples directly. The transient detector divides the signal into granules and determines, whether subgranules within the granules are to be flagged as transient. This information is sent to an envelope grouping block, which specifies the time/frequency grid to be used for the current granule. According to the grid, the block combines uniformly sampled subband signals in order to obtain non-uniformly sampled envelope values. These values might be the average or, alternatively, the maximum energy for the subband samples that have been combined. The envelope values are, together with the grouping information, fed to the envelope encoder block. This block decides in which direction (time or frequency) to encode the envelope values. The resulting signals, the output from the audio encoder, the wide band envelope information, and the control signals are fed to a multiplexer, forming a serial bitstream that is transmitted or stored.

On the decoder side, a de-multiplexer restores the signals and feeds the output of the perceptual audio encoder to an audio decoder, which produces a lowband digital audio signal. The envelope information is fed from the de-multiplexer to the envelope decoding block, which, by use of control data, determines in which direction the current envelope is coded and decodes the data. The lowband signal from the audio decoder is routed to a transposition module, which generates an estimate of the original highband signal consisting of one or several harmonics from the lowband signal. The highband signal is fed to an analysis filterbank, which is of the same type as on the encoder side. The subband signals are combined in a scale factor grouping unit. By use of control data from the de-multiplexer, the same type of combination and time/frequency distribution of the subband samples is adopted as on the encoder side. The envelope information from the demultiplexer and the information from the scale factor grouping unit is processed in a gain control module. The module computes gain factors to be applied to the subband samples prior to reconstruction using a synthesis filterbank block. The output of the synthesis filterbank is thus an envelope adjusted highband audio signal. The signal is added to the output of a delay unit, which is fed with the lowband audio signal. The delay compensates for the processing time of the highband signal. Finally, the obtained digital wideband signal is converted to an analogue audio signal in a digital to analogue converter.

When sustained chords are combined with sharp transients with mainly high frequency contents, the chords have high energy in the lowband and the transient energy is low, whereas the opposite is true in the highband. The envelope data that is generated during time intervals where transients are present is dominated by the high intermittent transient energy. Typical coders operate on a block basis, where every block represents a fixed time interval. Transient detector lookahead is employed on the encoder side so that envelope data spanning across borders of blocks can be processed. This enables a more flexible selection of time/frequency resolutions.

The international standard ISO/IEC 14496-3 discloses a time/frequency grid in Section 4.6.18.3.3, which describes the number of SBR envelopes and noise floors as well as the time segment associated with each SBR envelope and noise floor. Each time segment is defined by a start time border and a stop time border. The time slot indicated by the start time border is included in the time segment, the time slot indicated by the stop time border is excluded from the time segment. The stop time border of a segment equals the start time border of the next segment in the sequence of segments. Thus, time borders of SBR envelopes within a SBR frame are decodable on a decoder side. The corresponding time grid/frequency grid is determined by the encoder.

U.S. Pat. No. 6,453,282 B1 discloses a method and device for detecting a transient in a discrete-time audio signal. An encoder comprises a time/frequency transform device, a quantization/coding device and a bitstream formatting device. The quantization/coding stage is controlled by a psycho-acoustic model stage. The time/frequency transform stage is controlled by a transient detector, where the time/frequency transform is controlled to switch over from a long window to a short window in case of a detected transient. In the transient detector, either the energy of a filtered discrete-time audio signal in the current segment is compared with the energy of the filtered discrete-time audio signal in a preceding segment or a current relationship between the energy of the filtered discrete-time audio signal in the current segment and the energy of the unfiltered discrete-time audio signal in the current segment is formed and this current relationship is compared with a preceding corresponding relationship. Whether a transient is present in the discrete-time audio signal, is detected using one and/or the other of these comparisons.

The coding of speech signals is particularly demanding due to the fact that speech comprises not only vowels, which have a predominantly harmonic content, in which the majority of the overall energy is concentrated in the lower part of the spectrum, but also contains a significant amount of sibilants. A sibilant is a type of fricative or affricate consonant, made by directing a jet of air through a narrow channel in the vocal tract towards the sharp edge of the teeth. The term sibilant is often taken to be synonymous with the term strident. The term sibilant tends to have an articulatory or aerodynamic definition involving the production of a periodic noise at an obstacle. Strident refers to the perceptual quality of intensity as determined by amplitude and frequency characteristics of the resulting sound (i.e. an auditory or possibly acoustic definition).

Sibilants are louder than their non-sibilant counterparts, and most of their acoustic energy occurs at higher frequencies than non-sibilant fricatives. [s] has the most acoustic strength at around 8.000 Hz, but can reach as high as 10.000 Hz. [ʃ] has the bulk of its acoustic energy at around 4.000 Hz, but can extend up to around 8.000 Hz. For the sibilants, there do exist IPA symbols, where alveolar and post-alveolar sibilants are known. There also exist whistled sibilants and, depending on the corresponding language, other related sounds.

All these sibilant consonants in speech have in common that, if immediately preceded by a vowel, a strong shift of energy from the low frequency part into the high frequency part takes place. A transient detector, which is directed to the detection of an energy increase over time might not be in the position to detect this energy shift. This, however, may not be too problematic in baseband audio coding, in which e.g. a bandwidth extension is not applied, since sibilants have a duration which is, normally, longer than transient events occurring in a very short time context. In baseband coding such as AAC coding, the whole spectrum is encoded with a high frequency resolution. Therefore, an energy shift from the low frequency portion to the high frequency portion need not necessarily be detected due to the comparatively stationary nature of sibilants in speech signals, when the length of a sibilant such as a [s] in a word "sister" is compared to the frame length of a long window function. Furthermore, the high frequency part is encoded with a high bitrate anyway.

The situation, however, becomes problematic, when sibilants occur in the context of bandwidth extension. In bandwidth extension, the low frequency portion is encoded with a high resolution/high bitrate using a baseband coder such as an AAC encoder, and the highband is encoded with a small resolution/small bitrate typically only using certain parameters such as a spectral envelope using spectral envelope values which have a frequency resolution much lower than the frequency resolution of the baseband spectrum. To state it differently, the spectral distance between two spectral envelope parameters will be higher (e.g. at least ten times) than the spectral distance between the spectral values in the lowband spectrum.

On the decoder side, a bandwidth extension is performed, in which the lowband spectrum is used to regenerate the highband spectrum. When, in such a context, an energy shift from the lowband portion to the highband portion takes place, i.e., when a sibilant occurs, it becomes clear that this energy shift will significantly influence the accuracy/quality of the reconstructed audio signal. However, a transient detector looking for an increase (or decrease) in energy will not detect this energy shift, so that spectral envelope data for a spectral envelope frame, which covers a time portion before or after the sibilant, will be affected by the energy shift within the spectrum. On the decoder side, the result will be that due to the lack of time resolution, the whole frame will be reconstructed with an average energy, in the high frequency portion, i.e., not with the low energy before the sibilant and the high energy after the sibilant. This will result in a decrease of quality of the estimated signal.

SUMMARY

According to an embodiment, an apparatus for calculating bandwidth extension data of an audio signal in a bandwidth extension system, in which a first spectral band is encoded with a first number of bits and a second spectral band different from the first spectral band is encoded with a second number of bits, the second number of bits being smaller than the first number of bits, may have: a controllable bandwidth extension parameter calculator for calculating bandwidth extension parameters for the second frequency band in a frame-wise manner for a sequence of frames of the audio signal, wherein a frame includes a controllable start time instant; and a spectral tilt detector for detecting a spectral tilt in a time portion of the audio signal and for signalling the start time instant for the frame depending on the spectral tilt of the audio signal.

According to another embodiment, a method of calculating bandwidth extension data of an audio signal in a bandwidth extension system, in which a first spectral band is encoded with a first number of bits and a second spectral band different from the first spectral band is encoded with a second number of bits, the second number of bits being smaller than the first number of bits, may have the steps of: calculating bandwidth extension parameters for the second frequency band in a frame-wise manner for a sequence of frames of the audio signal, wherein a frame includes a controllable start time instant; and detecting a spectral tilt in a time portion of the audio signal and signalling the start time instant for the frame depending on the spectral tilt of the audio signal.

According to another embodiment, a computer program may have: a program code for performing, when running on a computer, the method of calculating bandwidth extension data of an audio signal in a bandwidth extension system, in which a first spectral band is encoded with a first number of bits and a second spectral band different from the first spectral band is encoded with a second number of bits, the second number of bits being smaller than the first number of bits, which method may have the steps of: calculating bandwidth extension parameters for the second frequency band in a frame-wise manner for a sequence of frames of the audio signal, wherein a frame includes a controllable start time instant; and detecting a spectral tilt in a time portion of the audio signal and signalling the start time instant for the frame depending on the spectral tilt of the audio signal.

The present invention is based on the finding that in the context of bandwidth extension, a shift of energy from the low frequency portion to the high frequency portion may be detected. In accordance with the present invention, a spectral tilt detector is applied for this purpose. When such a shift of energy is detected, although, for example, the total energy in the signal has not changed or has even been reduced, a start time instant signal is forwarded from the spectral tilt detector to a controllable bandwidth extension parameter calculator so that the bandwidth extension parameter calculator sets a start time instant for a frame of bandwidth extension parameter data. The end time instant of the frame can be set automatically, such as a certain amount of time subsequent to the start time instant or in accordance with a certain frame grid or in accordance with a stop time instant signal issued by the spectral tilt detector, when the spectral tilt detector detects the end of the frequency shift or, stated differently, the frequency shift back from the high frequency to the low frequency. Due to psycho-acoustic post-masking effects, which are much more significant than pre-masking effects, an accurate control of the start time instant of a frame is more important than a stop time instant of the frame.

Advantageously, and in order to save processing resources and processing delays, which may be used particularly for mobile device (e.g. mobile phones) applications, a spectral tilt detector is implemented as a low-level LPC analysis stage. Advantageously, the spectral tilt of a time portion of the audio signal is estimated based on one or several low-order LPC coefficients. Based on a threshold decision with a predetermined threshold of the spectral tilt, and advantageously based on a change in the sign of the spectral tilt which is a threshold decision with a threshold of zero, the issuance of the start time instant signal is controlled. When only the first LPC coefficient is used in the spectral tilt estimation, it is sufficient to only determine the sign of this first LPC coefficient, since this sign determines the sign of the spectral tilt and, therefore, determines whether a start time instant signal has to be issued to the bandwidth extension parameter calculator or not.

Advantageously, the spectral tilt detector cooperates with a transient detector, which is adapted for detecting an energy change, i.e., an energy increase or decrease of the whole audio signal. In an embodiment, the length of a bandwidth extension parameter frame is higher, when a transient in the signal has been detected, while the controllable bandwidth extension parameter calculator sets a shorter length of a frame, when the spectral tilt detector has signaled a start time instant signal.

BRIEF DESCRIPTION OF THE DRAWINGS

Embodiments of the present invention will be detailed subsequently referring to the appended drawings, in which:

FIG. 1*c* illustrates a table for controlling the time/frame resolution of the parameter calculator in response to signals from the spectral tilt detector and an additional transient detector;

FIG. 2*c* explains the calculation of the spectral tilt m based on low-order LPC parameters;

DETAILED DESCRIPTION OF THE INVENTION

Figure 2A:
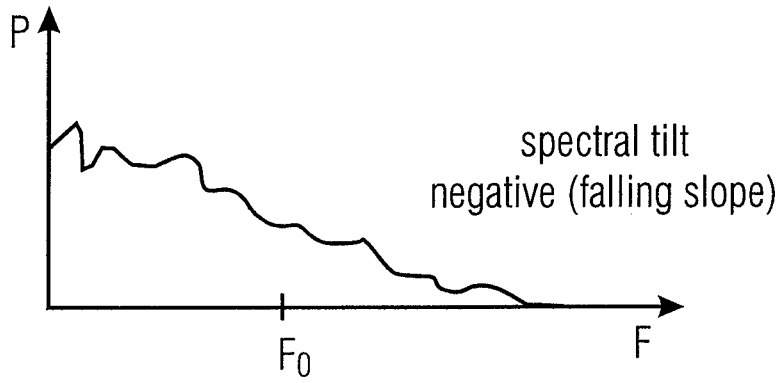
FIG. 2*a* illustrates a negative spectral tilt of a non-sibilant signal.
Figure 2B:
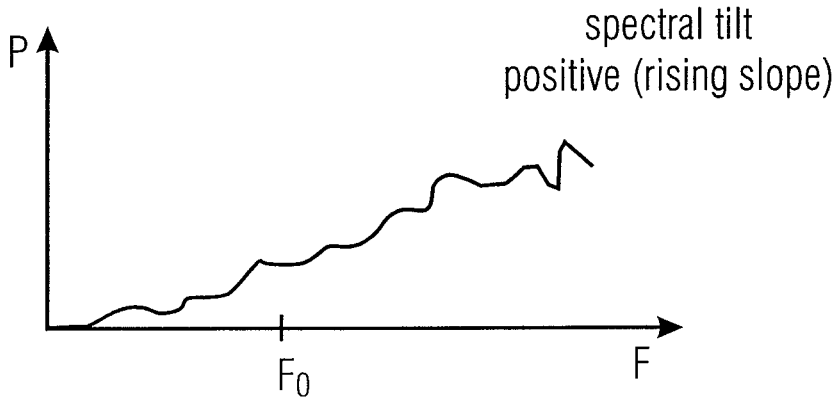
FIG. 2*b* illustrates a positive spectral tilt for a sibilant-like signal.
Figure 3:
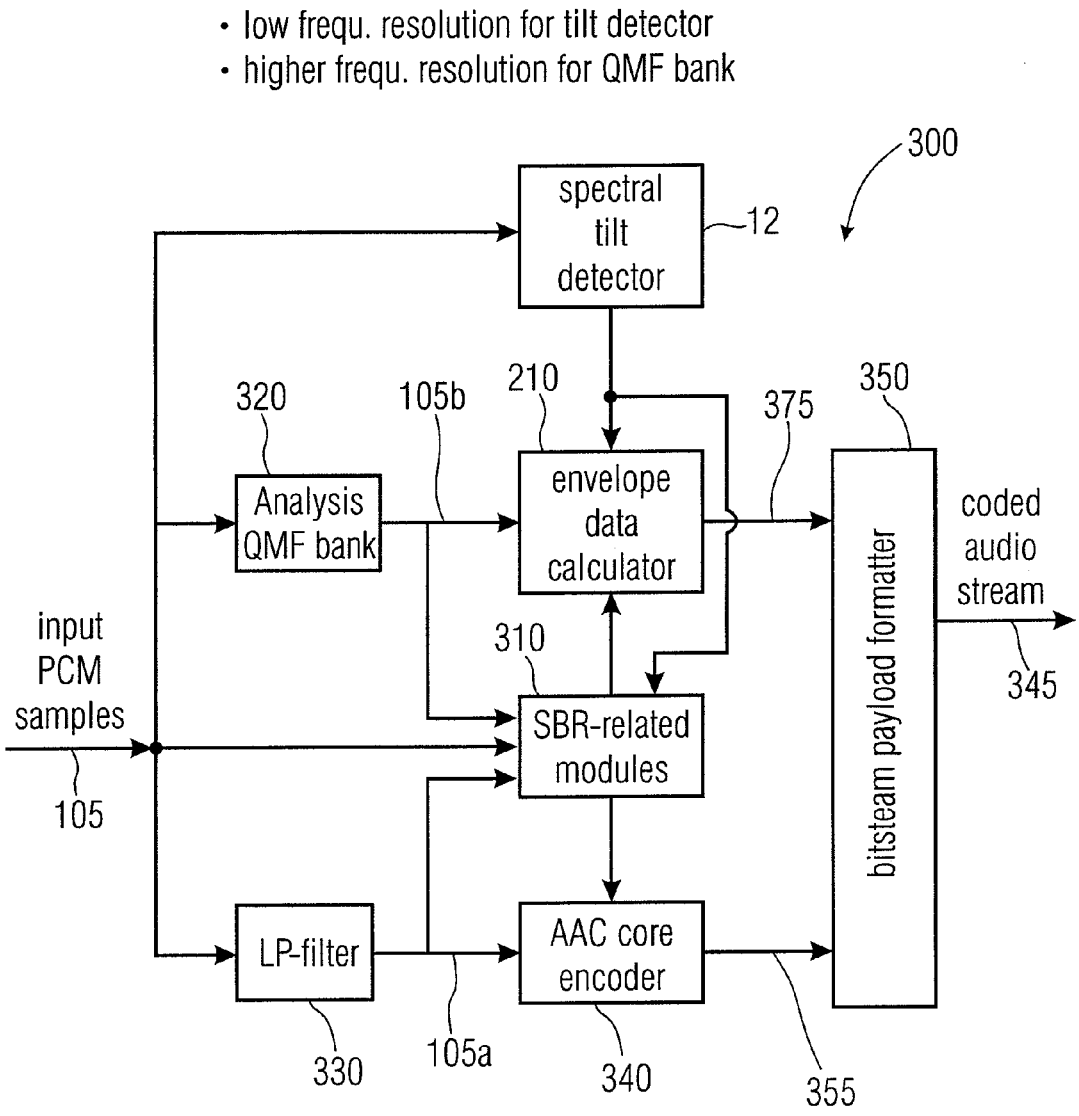
FIG. 3 illustrates a block diagram of an encoder in accordance with an advantageous embodiment of the present invention.
Figure 4:
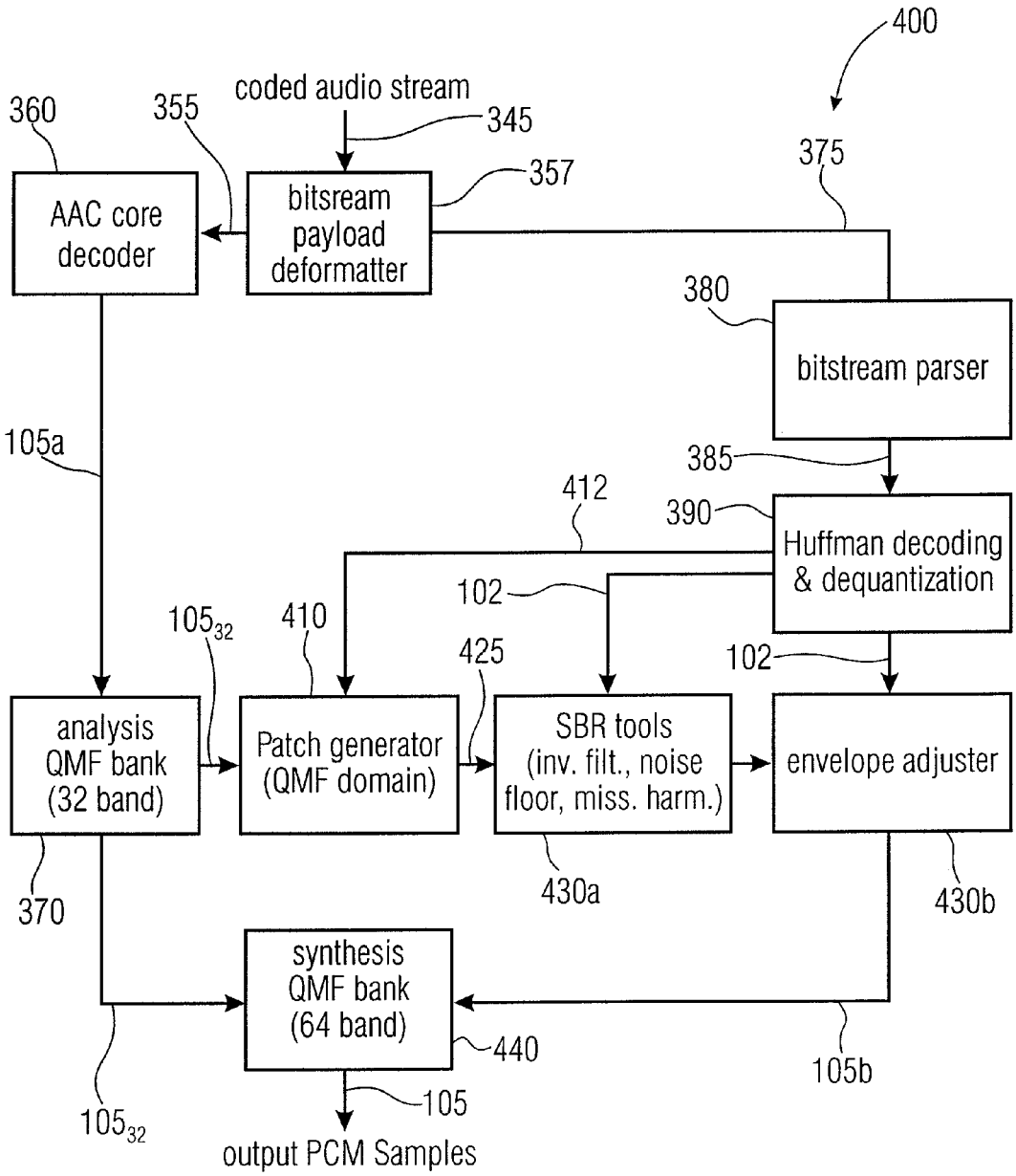
FIG. 4 illustrates a bandwidth extension decoder.

Before discussing FIGS. 1 and 2 in detail, a bandwidth extension scenario is described with respect to FIGS. 3 and 4.

FIG. 3 shows an embodiment for the encoder 300, which comprises SBR related modules 310, an analysis QMF bank 320, a low pass filter (LP-filter) 330, an AAC core encoder 340 and a bit stream payload formatter 350. In addition, the encoder 300 comprises the envelope data calculator 210. The encoder 300 comprises an input for PCM samples (audio signal 105; PCM=pulse code modulation), which is connected to the analysis QMF bank 320, and to the SBR-related modules 310 and to the LP-filter 330. The analysis QMF bank 320 may comprise a high pass filter to separate the second frequency band 105*b* and is connected to the envelope data calculator 210, which, in turn, is connected to the bit stream payload formatter 350. The LP-filter 330 may comprise a low pass filter to separate the first frequency band 105*a* and is connected to the AAC core encoder 340, which, in turn, is connected to the bit stream payload formatter 350. Finally, the SBR-related module 310 is connected to the envelope data calculator 210 and to the AAC core encoder 340.

Therefore, the encoder 300 down-samples the audio signal 105 to generate components in the core frequency band 105*a* (in the LP-filter 330), which are input into the AAC core encoder 340, which encodes the audio signal in the core frequency band and forwards the encoded signal 355 to the bit stream payload formatter 350 in which the encoded audio signal 355 of the core frequency band is added to the coded audio stream 345 (a bit stream). On the other hand, the audio signal 105 is analyzed by the analysis QMF bank 320 and the high pass filter of the analysis QMF bank extracts frequency components of the high frequency band 105*b* and inputs this signal into the envelope data calculator 210 to generate SBR data 375. For example, a 64 sub-band QMF BANK 320 performs the sub-band filtering of the input signal. The output from the filterbank (i.e. the sub-band samples) are complex-valued and, thus, over-sampled by a factor of two compared to a regular QMF bank.

The SBR-related module 310 may, for example, comprise an apparatus for generating the BWE output data and controls the envelope data calculator 210. Using the audio components 105*b* generated by the analysis QMF bank 320, the envelope data calculator 210 calculates the SBR data 375 and forwards the SBR data 375 to the bit stream payload formatter 350, which combines the SBR data 375 with the components 355 encoded by the core encoder 340 in the coded audio stream 345.

Alternatively, the apparatus for generating the BWE output data may also be part of the envelope data calculator 210 and the processor may also be part of the bitstream payload formatter 350. Therefore, the different components of the apparatus may be part of different encoder components of FIG. 3.

FIG. 4 shows an embodiment for a decoder 400, wherein the coded audio stream 345 is input into a bit stream payload deformatter 357, which separates the coded audio signal 355 from the SBR data 375. The coded audio signal 355 is input into, for example, an AAC core decoder 360, which generates the decoded audio signal 105*a* in the first frequency band. The audio signal 105*a* (components in the first frequency band) is input into an analysis 32 band QMF-bank 370, generating, for example, 32 frequency subbands $\mathbf{105}_{32}$ from the audio signal 105*a* in the first frequency band. The frequency subband audio signal $\mathbf{105}_{32}$ is input into the patch generator 410 to generate a raw signal spectral representation 425 (patch), which is input into an SBR tool 430*a*. The SBR tool 430*a* may, for example, comprise a noise floor calculation unit to generate a noise floor. In addition, the SBR tool 430*a* may reconstruct missing harmonics or perform an inverse filtering step. The SBR tool 430*a* may implement known spectral band replication methods to be used on the QMF spectral data output of the patch generator 410. The patching algorithm used in the frequency domain could, for example, employ the simple mirroring or copying of the spectral data within the frequency subband domain.

On the other hand, the SBR data 375 (e.g. comprising the BWE output data 102) is input into a bit stream parser 380, which analyzes the SBR data 375 to obtain different sub-information 385 and input them into, for example, an Huffman decoding and dequantization unit 390 which, for example, extracts the control information 412 and the spectral band replication parameters 102, implying a certain framing time resolution of SBR data. The control information 412 controls the patch generator 410. The spectral band replication parameters 102 are input into the SBR tool 430*a* as well as into an envelope adjuster 430*b*. The envelope adjuster 430*b* is operative to adjust the envelope for the generated patch. As a result, the envelope adjuster 430*b* generates the adjusted raw signal 105*b* for the second frequency band and inputs it into a synthesis QMF-bank 440, which combines the components of the second frequency band 105*b* with the audio signal in the frequency domain $\mathbf{105}_{32}$. The synthesis QMF-bank 440 may, for example, comprise 64 frequency bands and generates by combining both signals (the components in the second frequency band 105*b* and the subband domain audio signal $\mathbf{105}_{32}$) the synthesis audio signal 105 (for example, an output of PCM samples, PCM=pulse code modulation).

The synthesis QMF bank 440 may comprise a combiner, which combines the frequency domain signal $\mathbf{105}_{32}$ with the second frequency band 105*b* before it will be transformed into the time domain and before it will be output as the audio signal 105. Optionally, the combiner may output the audio signal 105 in the frequency domain.

The SBR tools 430*a* may comprise a conventional noise floor tool, which adds additional noise to the patched spectrum (the raw signal spectral representation 425), so that the spectral components 105*a* that have been transmitted by a core coder 340 and that are used to synthesize the components of the second frequency band 105*b* exhibit similar tonality properties like the second frequency band 105*b*, as depicted in FIG. 3, of the original signal.

Figure 1A:
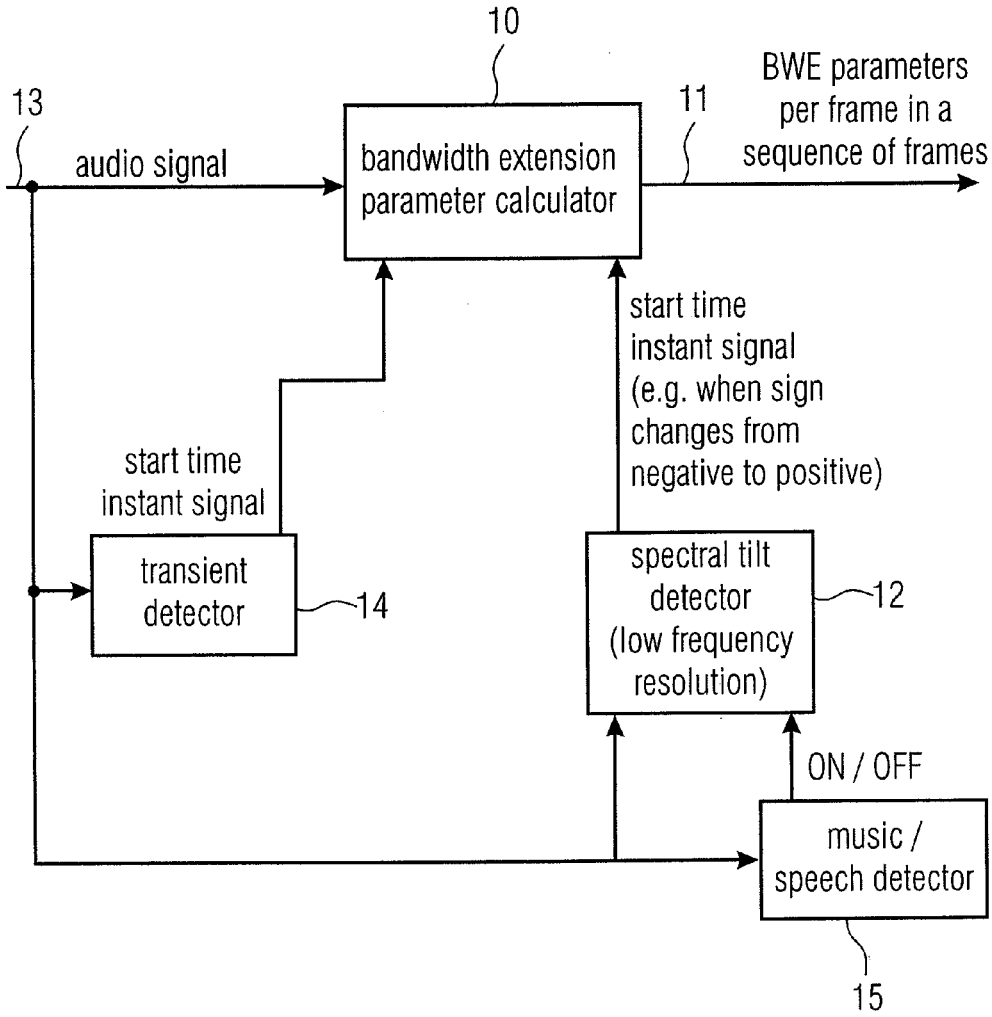
FIG. 1*a* is an advantageous embodiment of an apparatus/method for calculating bandwidth extension data of an audio signal.

FIG. 1*a* illustrates an apparatus for calculating bandwidth extension data of an audio signal in a bandwidth extension system, in which a first spectral band is encoded with a first number of bits and a second spectral band different from the first spectral band is encoded with a second number of bits. The second number of bits is smaller than the first number of bits. Advantageously, the first frequency band is the low frequency band and the second frequency band is the high frequency band, although other bandwidth extension scenarios are known, in which the first frequency band and the second frequency band are different from each other, but are not the lowband and the highband. Furthermore, in accordance with the key teaching of bandwidth extension techniques, the highband is encoded much coarser than the lowband. Advantageously, the bit rate that may be used for the highband is at least 50% or even more advantageously at least 90% reduced with respect to the bitrate for the lowband. Thus, the bitrate for the second frequency band is 50% or even less than the bitrate for the lowband.

The apparatus illustrated in FIG. 1*a* comprises a controlled bandwidth extension parameter calculator 10 for calculating bandwidth extension parameters 11 for the second spectral band in a frame-wise manner for a sequence of frames of the audio signal. The controllable bandwidth extension parameter calculator 10 is configured to apply a controllable start time instant for a frame of the sequence of frames.

The inventive apparatus furthermore comprises a spectral tilt detector 12 for detecting a spectral tilt in a time portion of the audio signal, which is provided via line 13 to different modules in FIG. 1*a*. The spectral tilt detector is configured for signalling a start time instant for a frame of the audio signal depending on a spectral tilt of the audio signal to the controllable bandwidth extension parameter calculator 10 so that the bandwidth extension parameter calculator 10 is in the position to apply a start time border as soon as a start time instant signalled from the spectral tilt detector 12 has been received.

Advantageously, a spectral tilt signal/start time instant signal is output, when a sign of a spectral tilt of the time portion of the audio signal is different from a sign of the spectral tilt of the audio signal in the preceding time portion of the audio signal. Even more advantageously, a start time instant signal is issued, when the spectral tilt changes from negative to positive. Analogously, a stop time instant can be signalled from the spectral tilt detector 12 to the bandwidth extension parameter calculator 10 when a spectral tilt change from a positive spectral tilt to a negative spectral tilt takes place. However, the stop time instant can be derived without having regard to spectral tilt changes in the audio signal. Exemplarily, the stop time instant of the frame can be set by the bandwidth extension parameter calculator autonomously, when a certain time period has expired since the start time instant of the corresponding frame.

In the advantageous embodiment illustrated in FIG. 1*a*, an additional transient detector 14 is provided, which analyses the audio signal 13 in order to detect energy changes in the whole signal from one time portion to the next time portion. When a certain minimum energy increase from one time portion to the next time portion is detected, the transient detector 14 is configured for outputting a start time instant signal to the controllable bandwidth extension parameter calculator 10 so that the bandwidth extension parameter calculator sets a start time instant of a new bandwidth extension parameter frame of the sequence of bandwidth extension parameter data frames.

Advantageously, the apparatus for calculating bandwidth extension data furthermore comprises a music/speech detector 15 for detecting, whether a current time portion of the audio signal is a music signal or a speech signal. In case of a music signal, the music/speech detector 15 will, advantageously, disable the spectral tilt detector 12 in order to save power/computing resources and in order to avoid bit rate increases due to unnecessary small frames in non-speech signals. This feature is particularly useful for mobile devices, which have limited processing resources and which have, even more importantly, limited power/battery resources. Then, however, the music/speech detector 15 detects a speech portion in the audio signal 13, the music/speech detector enables the spectral tilt detector. A combination of the music/speech detector 15 with the spectral tilt detector 12 is advantageous in that spectral tilt situations mainly occur during speech portions, but do occur, with less probability during music portions. Even when those situations occur during music passages, the missing of these occurrences is not so dramatic due to the fact that music has a much better masking characteristic than speech. Sibilants are, as has been found out, important for the intelligibility of decoded speech and important for the subjective quality impression the listener has. Stated differently, the authenticity of speech is much related to the clear reproduction of sibilant portions of speech. This is, however, not so critical for music signals.

Figure 1B:
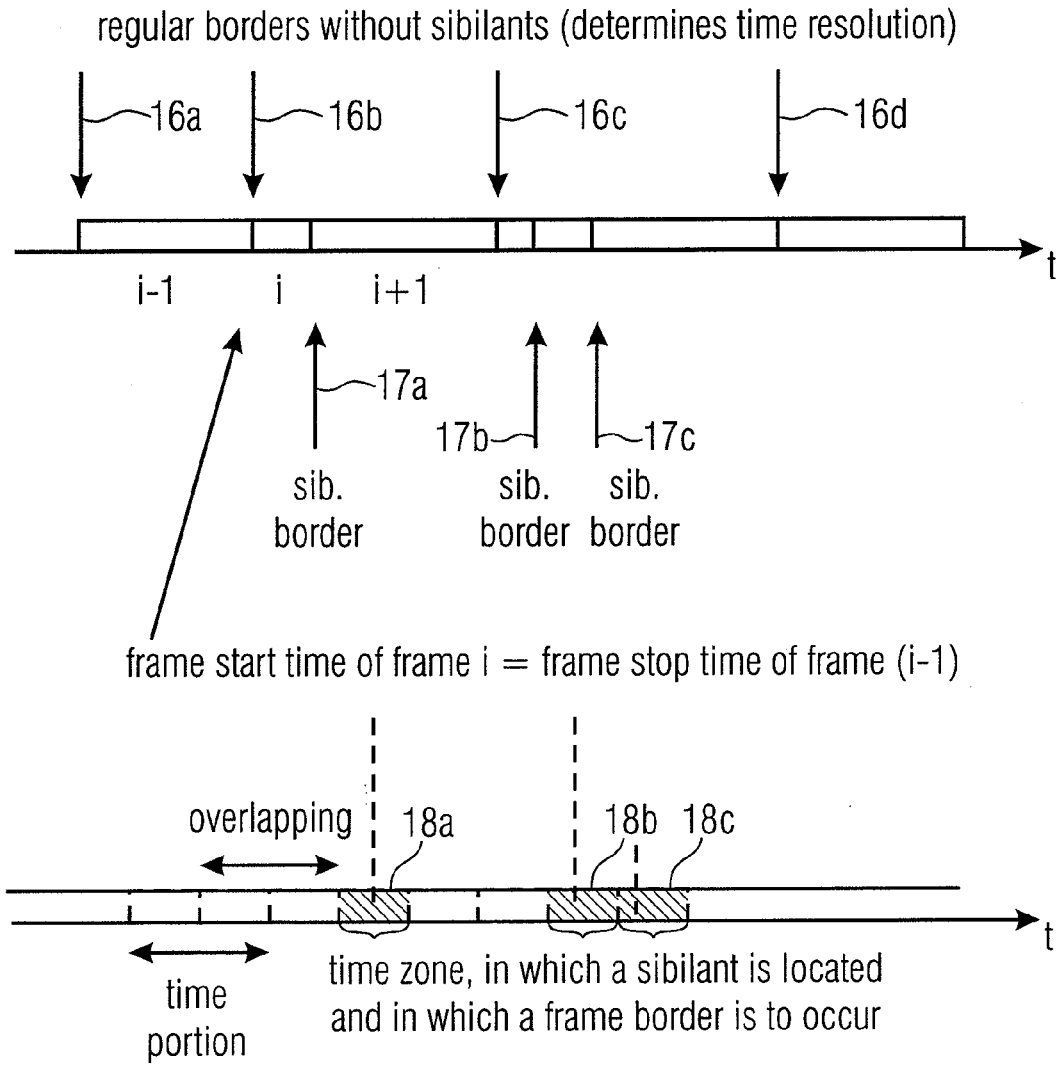
FIG. 1*b* illustrates the resulting framing for an audio signal having transients and the corresponding time portions of the spectral tilt detector.

FIG. 1*b* illustrates an upper time line illustrating the framing set by the bandwidth extension parameter calculator for a certain portion in time of an audio signal. The framing comprises several regular borders, which occur in the framing without a detection of sibilants, which are indicated at 16*a*-16*d*. Additionally, the framing comprises several frame borders which originate from the inventive sibilant or spectral tilt change detection. Theses borders are indicated at 17*a*-17*c*. Additionally, FIG. 1*b* makes clear that the frame start time of a certain frame such a frame i is coincident with a frame stop time of the frame i-l, i.e., a preceding frame.

In the FIG. 1*b* embodiment, the stop time instants such as the regular borders 16*a*-16*d* of the frames are set automatically after the expiration of a certain time period after a frame start time instant. The length of this period determines the time resolution for bandwidth extension parameter framing without the detection of sibilants.

As illustrated in FIG. 1*c*, this time resolution can be set Based on whether a start time instant signal originates from the transient detector 14 in FIG. 1*a* or the spectral tilt detector 12 in FIG. 1*a*. A general rule in the embodiment illustrated in FIG. 1*c* is that, as soon as the start time instant signal is received from the spectral tilt detector, a higher time resolution (smaller time period between the start time instant and the stop time instant of the framing illustrated in FIG. 1*b*) is set. When, however, the spectral tilt detector does not detect anything, but the transient detector 14 actually detects a transient, then this means that only an energy increase has taken place, but an energy shift has not taken place. In such a situation, the automatically set stop time instant of the frame is farther apart in time from the start time instant due to the fact that a sibilant is obviously not in the audio signal and a—non problematic—music signal or other audio signal is present.

In this context, it is to be noted that setting borders in dependence on a transient detector or a spectral tilt detector increases the bitrate of the encoded signal. The lowest possible bitrate would be obtained, if the frames in FIG. 1*b* would have a large length. On the other hand, however, a large framing reduces the time resolution of the bandwidth extension parameter data. Therefore, the present invention makes it possible to set a new start time instant (which means a stop time instant of the preceding frame), only when it may actually be used. Additionally, the varying time resolution depending on the actual situation, i.e., whether a transient was detected or a tilt change (e.g. caused by a sibilant) was detected, allows to adapt even further the framing in an optimal way to the quality/bitrate requirements so that an optimum compromise between both contradicting targets can be reached.

The lower time line in FIG. 1*b* illustrates an exemplary time processing performed by the spectral tilt detector 12. In the FIG. 1*b* embodiment, the spectral tilt detector operates in a block-based way and, specifically in an overlapping way so that overlapping time portions are searched for spectral tilt situations. However, the spectral tilt detector can also operate on a continuous stream of samples and does not necessarily have to apply the block-based processing illustrated in FIG. 1*b*.

Advantageously, the start time instant of the frame is set shortly before the detection time of a spectral tilt change. However, the controllable bandwidth extension parameter calculator has some freedom for setting a new frame border as long as it is assured that, with respect to a regular frame, the start of the transient detected by the transient detector or the start of the sibilant detected by the spectral tilt detector is located within the first 25% of the frame with respect to time or even more advantageously is located within the first 10% in time of the frame length in a regular framing, in which it is set, when a spectral tilt output signal is not obtained.

Advantageously, it is additionally made sure that at least a portion of the detected spectral tilt change is in the new frame and is not located in the earlier frame, but there might occur situations, in which a certain "beginning portion" of a spectral tilt change becomes located in the preceding frame. This beginning portion, however, should advantageously be less than 10% of the whole time of the spectral tilt change.

In the FIG. 1*b* embodiment, a spectral tilt has been detected in a time zone 18*a*, 18*b* and 18*c*, and the "time instant" of the spectral tilt change is set to be occurring in the time zone 18*a*. Thus, the controllable bandwidth extension parameter calculator 10 will make sure that a frame is set at any time instant within a time zone 18*a*, 18*b*, 18*c*. This feature allows the bandwidth extension parameter calculator to keep a certain basic framing in case such a basic framing may be used, provided that the significant portion of the spectral tilt change is located subsequent to the start time instant, i.e., not in the earlier frame but in the new frame.

FIG. 2*a* illustrates a power spectrum of a signal having a negative spectral tilt. A negative spectral tilt means a falling slope of the spectrum. Contrary thereto, FIG. 2*b* illustrates a power spectrum of a signal having a positive spectral tilt. Said in other words, this spectral tilt has a rising slope. Naturally, each spectrum such as the spectrum illustrated in FIG. 2*a* or the spectrum illustrated in FIG. 2*b* will have variations in a local scale which have slopes different from the spectral tilt.

The spectral tilt may be obtained, when, for example, a straight line is fitted to the power spectrum such as by minimizing the squared differences between this straight line and the actual spectrum. Fitting a straight line to the spectrum can be one of the ways for calculating the spectral tilt of a short-time spectrum. However, it is advantageous to calculate the spectral tilt using LPC coefficients.

The publication "Efficient calculation of spectral tilt from various LPC parameters" by V. Goncharoff, E. Von Colln and R. Morris, Naval Command, Control and Ocean Surveillance Center (NCCOSC), RDT and E Division, San Diego, Calif. 92152-52001, May 23, 1996 discloses several ways to calculate the spectral tilt.

In one implementation, the spectral tilt is defined as the slope of a least-squares linear fit to the log power spectrum. However, linear fits to the non-log power spectrum or to the amplitude spectrum or any other kind of spectrum can also be applied. This is specifically true in the context of the present invention, where, in the advantageous embodiment, one is mainly interested in the sign of the spectral tilt, i.e., whether the slope of the linear fit result is positive or negative. The actual value of the spectral tilt, however, is of no big importance in the advantageous embodiment of the present invention, in which the sign is considered, i.e. a threshold decision with a zero threshold is applied. In other embodiments, however, a threshold different from zero can be useful as well.

When linear predictive coding (LPC) of speech is used to model its short-time spectrum, it is computationally more efficient to calculate spectral tilt directly from the LPC model parameters instead of from the log power spectrum. FIG. 2*c* illustrates an equation for the cepstral coefficients $c_k$ corresponding to the $n^{th}$ order all-pole log power spectrum. In this equation, k is an integer index, $p_n$ is the $n^{th}$ pole in the all-pole representation of the z-domain transfer function H(z) of the LPC filter. The next equation in FIG. 2*c* is the spectral tilt in terms of the cepstral coefficients. Specifically, m is the spectral tilt, k and n are integers and N is the highest order pole of the all-pole model for H(z). The next equation in FIG. 2*c* defines the log power spectrum $S(\omega)$ of the $N^{th}$ order LPC filter. G is the gain constant and $\alpha_k$ are the linear predictor coefficients, and $\omega$ is equal to $2\times\pi\times f$, where f is the frequency. The lowest equation in FIG. 2*c* directly results in the cepstral coefficients as a function of the LPC coefficients $\alpha_k$. The cepstral coefficients $c_k$ are then used to calculate the spectral tilt. Generally, this method will be more computationally efficient than factoring the LPC polynomial to obtain the pole values, and solving for spectral tilt using the pole equations. Thus, after having calculated the LPC coefficients $\alpha_k$, one can calculate the cepstral coefficients $c_k$ using the equation at the bottom of FIG. 2*c* and, then, one can calculate the poles $p_n$ from the cepstral coefficients using the first equation in FIG. 2*c*. Then, based on the poles, one can calculate the spectral tilt m as defined in the second equation of FIG. 2*c*.

It has been found that the first order LPC coefficient $\alpha_1$ is sufficient for having a good estimate for the sign of the spectral tilt. $\alpha_1$ is, therefore, a good estimate for $c_1$. Thus, $c_1$ is a good estimate for $p_1$. When $p_1$ is inserted into the equation for the spectral tilt m, it becomes clear that, due to the minus sign in the second equation in FIG. 2*c*, the sign of the spectral tilt m is inverse to the sign of the first LPC coefficient $\alpha_1$ in the LPC coefficient definition in FIG. 2*c*.

FIG. 3 illustrates the spectral tilt detector 12 in the context of an SBR encoder system. Specifically, the spectral tilt detector 12 controls the envelope data calculator and other SBR-related modules in order to apply a start time instant of a frame of SBR-related parameter data. FIG. 3 illustrates the analysis QMF bank 320 for decomposing the second frequency band, which is advantageously the high band, into a certain number of sub-bands such as 32 sub-bands in order to perform a sub-band-wise calculation of the SBR parametric data. Advantageously, the spectral tilt detector performs a simple LPC analysis to retrieve only the first order LPC coefficient as discussed in the context of FIG. 2*c*. Alternatively, the spectral tilt detector 12 performs a spectral analysis of the input signal and calculates the spectral tilt, for example, using the linear fit or any other way for calculating the spectral tilt. Generally, it will be advantageous that the resolution of the spectral tilt detector with respect to a frequency decomposition is lower than the frequency resolution of the QMF bank 320. In other embodiments, the spectral tilt detector 12 will not perform any kind of frequency decomposition such as in the context of calculating only the first order LPC coefficient $\alpha_1$ as discussed in the context of FIG. 2*c*.

In other embodiments, the spectral tilt detector is configured to not only calculate the first order LPC coefficients but to calculate several low order LPC coefficients such as LPC coefficients until the order of 3 or 4. In such an embodiment, the spectral tilt is calculated to such an high accuracy that one can not only signal a new frame when the slope changes from negative to positive, but it is also advantageous to trigger a new frame, when the spectral tilt changes from a high magnitude with a negative sign for a very tonal signal to a low magnitude (absolute value) with the same sign. Furthermore, with respect to the stop time instant, it is advantageous to calculate the end of a frame, when the spectral tilt has changed from a high positive value to a low positive value, since this can be an indication that the characteristic of the signal changes from sibilant to non-sibilant. Irrespective of the way of calculating the spectral tilt, the detection of a frame start time instant can not only be signalled by a sign change, but can, alternatively or additionally, be signalled by a tilt value change in a certain predetermined time period, which is above a decision threshold.

In the sign embodiment, the decision threshold is an absolute threshold at a tilt value of zero, and in the change embodiment, the threshold is a threshold indicating a change of the tilt, and this calculation can also be carried out by applying an absolute threshold in a function obtained by calculating the first derivative of the tilt function over time. Here, the spectral tilt detector is configured to signal the start time instant of the frame, when a difference value between a spectral tilt value of the time portion of the audio signal and a spectral tilt value of the audio signal in the preceding time portion of the audio signal is higher than a predetermined threshold value. The difference value can be an absolute value (e.g. for negative difference values) or a value with a sign (e.g. for positive difference values) and the predetermined threshold value is, in this embodiment, different from zero.

As discussed in the context of FIGS. 3 and 4, the bandwidth extension parameter calculator 10 is configured to calculate the spectral envelope parameters. In other embodiments, however, it is advantageous that the bandwidth extension parameter calculator additionally calculates noise floor parameters, inverse filtering parameters and/or missing harmonic parameters as known from the bandwidth extension portion of MPEG 4.

Basically, it is advantageous to set a stop time instant of a frame in response to a spectral tilt detector output signal or in response to an event independent of the spectral tilt detector output signal. The event used by the bandwidth extension parameter calculator to signal a frame stop time instant is, for example, the occurrence of a time instant being a fixed time period later in time with respect to the start time instant. As discussed in the context of FIG. 1*c*, this fixed time period can be low or high. When this fixed time period is high, then this means that there is a low time resolution, and when this fixed time period is low, then this means that there is a high time resolution. Advantageously, when the transient detector 14 signals a transient, the first time period is set, but a low time resolution is applied. In this embodiment, the fixed time period later in time with respect to the start time instant is, therefore, higher than in the other case, where a start time instant signal is output by the spectral tilt detector. When a start time instant is output by the spectral tilt detector, then this means that there is a sibilant portion in a speech signal, and, therefore, a high time resolution may be used. Therefore, the fixed time period is set to be smaller than in the case, where a start time instant for a frame was signalled by the transient detector 14 in FIG. 1*a*.

In other embodiments, a spectral tilt detector can be based on linguistic information in order to detect sibilants in speech. When, for example, a speech signal has associated meta information such a the international phonetic spelling, then an analysis of this meta information will provide a sibilant detection of a speech portion as well. In this context, the meta data portion of the audio signal is analyzed.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computerreadable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for calculating bandwidth extension data of an audio signal in a bandwidth extension system, wherein a first spectral band is encoded with a first number of bits and a second spectral band different from the first spectral band is encoded with a second number of bits, the second number of bits being smaller than the first number of bits, comprising:

a controllable bandwidth extension parameter calculator for calculating bandwidth extension parameters for the second frequency band in a frame-wise manner for a sequence of frames of the audio signal, wherein a frame comprises a controllable start time instant; and a spectral tilt detector for detecting a spectral tilt in a time portion of the audio signal and for signalling the controllable start time instant for the frame depending on the spectral tilt of the audio signal, wherein at least one of the controllable bandwidth extension parameter calculator and the spectral tilt detector comprises a hardware implementation.

2. The apparatus in accordance with claim 1, wherein the spectral tilt detector is configured to signal the controllable start time instant of the frame, when a sign of a spectral tilt of the time portion of the audio signal is different from a sign of the spectral tilt of the audio signal in the preceding time portion of the audio signal.

3. The apparatus in accordance with claim 1, wherein the spectral tilt detector is operative to perform an LPC analysis of the time portion for estimating one or more low order LPC coefficients and to analyze the one or more low order LPC coefficients for determining, whether the portion of the audio signal comprises a positive or a negative spectral tilt.

4. The apparatus in accordance with claim 3, wherein the spectral tilt detector is operative to only calculate the first LPC coefficient and to not calculate additional LPC coefficients and to analyze a sign of the first LPC coefficient and to signal the controllable start time instant of the frame depending on the sign of the first LPC coefficient.

5. The apparatus in accordance with claim 4, wherein the spectral tilt detector is configured for determining the spectral tilt as a negative spectral tilt, wherein a spectral energy decreases from lower frequencies to higher frequencies, when the first LPC coefficient comprises a positive sign, and to detect the spectral tilt as a positive spectral tilt, wherein the spectral energy increases from lower frequencies to higher frequencies, when the first LPC coefficient comprises a negative sign.

6. The apparatus in accordance with claim 1, wherein the controllable bandwidth extension parameter calculator is configured for calculating one or more of the following parameters for the frame:

spectral envelope parameters, noise parameters, inverse filtering parameters, or missing harmonics parameters.

7. The apparatus in accordance with claim 1, wherein the controllable bandwidth extension parameter calculator is configured for setting the controllable start time instant of a frame depending on a start time instant of the time portion of the audio signal, on which the spectral tilt detection is based.

8. The apparatus in accordance with claim 7, wherein the controllable bandwidth extension parameter calculator is configured to set the controllable start time instant of the frame identical to the start time instant of the time portion, wherein the spectral tilt change has been detected.

9. The apparatus in accordance with claim 1, wherein the controllable bandwidth extension parameter calculator or the spectral tilt detector are configured to process overlapping frames or time portions.

10. The apparatus in accordance with claim 1, wherein the controllable bandwidth extension parameter calculator is operative to set a stop time instant of a frame in response to the spectral tilt detector or in response to an event independent on a spectral tilt of the audio signal.

11. The apparatus in accordance with claim 10, wherein the event used by the controllable bandwidth extension parameter calculator is the occurrence of a time instant being a fixed time period later in time than the controllable start time instant.

12. The apparatus in accordance with claim 1, wherein the controllable bandwidth extension parameter calculator is configured for performing a frequency selective processing of the audio signal in the second spectral band with a frequency resolution, and wherein the spectral tilt detector is operative to process the time portion in the time domain or in a frequency selective way with a frequency resolution being smaller than the frequency resolution used by the controllable bandwidth extension parameter calculator.

13. The apparatus in accordance with claim 1, further comprising:

a transient detector for controlling the controllable bandwidth extension parameter calculator to set the controllable start time instant, when a transient is detected, wherein the controllable bandwidth extension parameter calculator is configured to set the controllable start time instant, when either the spectral tilt detector or the transient detector has output a start time instant signal.

14. The apparatus in accordance with claim 1, further comprising a speech/music detector, the speech/music detector being operative to activate the spectral tilt detector in a speech portion of the audio signal and to deactivate the spectral tilt detector in a music portion of the audio signal.

15. The apparatus in accordance with claim 1, wherein the spectral tilt detector is configured for determining, whether the time portion comprises a sibilant of a speech portion or a non-sibilant of a speech portion, wherein the spectral tilt detector is configured to signal the controllable start time instant for the frame, when a change from a non-sibilant to a sibilant is detected.

16. The apparatus in accordance with claim 13, wherein the controllable bandwidth extension parameter calculator is configured for applying the sequence of frames with a higher time resolution in response to a signalling from the spectral tilt detector compared to a time resolution applied, when the controllable bandwidth extension parameter calculator has received a signalling from the transient detector in a time portion of the audio signal, for which the spectral tilt detector has not signalled the controllable start time instant.

17. The apparatus in accordance with claim 1, wherein the spectral tilt detector is configured to signal the controllable start time instant of the frame, when a difference between a spectral tilt value of the time portion of the audio signal and a spectral tilt value of the audio signal in the preceding time portion of the audio signal is greater than a predetermined threshold value.

18. A method of calculating bandwidth extension data of an audio signal in a bandwidth extension system, wherein a first spectral band is encoded with a first number of bits and a second spectral band different from the first spectral band is encoded with a second number of bits, the second number of bits being smaller than the first number of bits, comprising:

calculating, by controllable bandwidth extension parameter calculator, bandwidth extension parameters for the second frequency band in a frame-wise manner for a sequence of frames of the audio signal, wherein a frame comprises a controllable start time instant; and detecting, by a spectral tilt detector, a spectral tilt in a time portion of the audio signal and signalling the controllable start time instant for the frame depending on the spectral tilt of the audio signal, wherein at least one of the controllable bandwidth extension parameter calculator and the spectral tilt detector comprises a hardware implementation.

19. A non-transitory storage medium having stored thereon a computer program comprising a program code for performing, when running on a computer, a method of calculating bandwidth extension data of an audio signal in a bandwidth extension system, wherein a first spectral band is encoded with a first number of bits and a second spectral band different from the first spectral band is encoded with a second number of bits, the second number of bits being smaller than the first number of bits, said method comprising:

calculating bandwidth extension parameters for the second frequency band in a frame-wise manner for a sequence of frames of the audio signal, wherein a frame comprises a controllable start time instant; and detecting a spectral tilt in a time portion of the audio signal and signalling the controllable start time instant for the frame depending on the spectral tilt of the audio signal.

* * * * *